US005487199A

United States Patent [19]

Nelson

[11] Patent Number: 5,487,199

[45] Date of Patent: Jan. 30, 1996

[54] VANDALISM PREVENTION DEVICE FOR HIGHWAY BRIDGES

[76] Inventor: John Nelson, 1811 Tramway Dr., Sandy, Utah 84092

[21] Appl. No.: 222,718

[22] Filed: Apr. 4, 1994

[51] Int. Cl.[6] ..... E01D 1/00

[52] U.S. Cl. ..... 14/74.5; 52/731.1

[58] Field of Search ..... 14/74.5, 78; 52/731.1, 52/729, 731.7

[56] References Cited

U.S. PATENT DOCUMENTS

| | | | |
|---|---|---|---|
| 1,989,834 | 2/1935 | Watson | 14/74.5 X |
| 2,151,267 | 3/1939 | Finsterwalder . | |
| 2,712,750 | 7/1955 | Finsterwalder . | |
| 2,964,807 | 12/1960 | Kennedy . | |
| 3,257,764 | 6/1966 | Cripe . | |
| 3,342,007 | 9/1967 | Merson | 52/729 |
| 3,626,648 | 12/1971 | Beckham . | |
| 4,123,031 | 10/1978 | Hyre | 249/24 |

*Primary Examiner*—William P. Neuder
*Attorney, Agent, or Firm*—Thorpe, North & Western

[57] ABSTRACT

An apparatus and method are disclosed for preventing or inhibiting the vandalism of bridges and other like structures. The apparatus includes a slant plate device having an elongate plate which is positioned so as to extend downwardly and outwardly from a central position on the vertical wall of an I-beam to a position adjacent a far lateral edge of the bottom flange of the I-beam. The plate is sloped sufficiently to inhibit a person from standing on the lower flange of the I-beam while applying graffiti or otherwise vandalizing the bridge. Several different support and attachment structures are also disclosed. The method includes positioning the elongate plate at an angle and attaching the plate to some permanent structure associated with the I-beam.

16 Claims, 3 Drawing Sheets

VANDALISM PREVENTION DEVICE FOR HIGHWAY BRIDGES

BACKGROUND OF THE INVENTION

The invention relates to a method and apparatus for inhibiting vandalism to highway bridges and similar structures, and in particular, to a method for preventing vandals from standing on the I-beams which support the bridge while vandalizing the bridge.

Vandalism to public property, and in particular graffiti, has long been a nuisance in large cities. When graffiti appeared, it was usually painted over within a short period of time to prevent the loss to property value in the surrounding community. Overall, this graffiti presented a small problem when compared to other issues faced by cities.

Recently, however, the problem of graffiti and other similar vandalism has increased significantly in big cities and has spread rapidly across the entire country. The problem is no longer confined to major metropolitan areas, but is increasingly present in medium-sized cities and even small towns. One primary source of graffiti is "taggers"—teenagers who wish to leave their mark in as many public places as possible. The other primary source of graffiti is gangs which use the graffiti to mark their "territory". Regardless of its source, the graffiti is usually an eyesore and decreases property values in the area.

The surge in graffiti from both sources is spreading across the country at an alarming rate. Virtually everywhere the problem is increasing. An official of one western state recently noted that his state's transportation department had spent three times as much money removing graffiti in the first three months of 1994 as had been spent during the entire year of 1993. He noted that, despite the significant increase in expenditures on graffiti removal, the vandals appeared to be gaining ground as each day additional graffiti was visible along the roadsides and on bridges.

A particular problem with graffiti is that done on bridges. When writing on the bridge, the vandals will typically climb on to the I-beams which support the bridge and stand on the lower flange of the I-beam while the graffiti is applied. To remove the graffiti, the public works employees are faced with the challenge of either (a) repeating the dangerous climb of the vandals; (b) blocking off traffic while some sort of raised platform is used to allow workers to paint over the graffiti; or (c) use long telescoping poles to cover the graffiti and attempt not to drip paint onto cars passing beneath the bridge.

These difficult options have resulted in many areas of the country simply giving up on removing the graffiti. Rather than painting over the graffiti, the bridges are allowed to become an eyesore and free advertising for the particular cause of the vandal. Consequently, the neighborhoods around the bridge begin to deteriorate as the presence of graffiti attracts more graffiti. Eventually, the property values may decrease and the neighborhood may fall into disrepair.

Thus, there is an urgent need for a method and apparatus which will hinder the application of graffiti to bridges, overpasses and the like. It is also important that the method be relatively inexpensive so to not offset the savings obtained in preventing the vandalism.

SUMMARY OF THE INVENTION

It is an object of the invention to provide an apparatus and method which will decrease the ability of vandals to paint graffiti on bridges, overpasses and the like.

It is another object of the invention to provide an apparatus which may be attached to the structure of existing bridges.

It is yet another object of the invention to provide a method and apparatus which prevents vandals from standing on the I-beams while applying graffiti.

The above and other objects and features of the invention are disclosed by an slant plate device including a generally sloped plate extending from a center position of a vertical wall forming the I-beam to a position adjacent a lateral extreme of a flange forming a lower portion of the I-beam. The sloped plate is positioned so as to prevent a vandal from standing on the lower flange of the I-beam, or using it for support. The sloped portion can be attached to the I-beam in numerous different ways including adhesives, screws, bolts and the like.

The method of the present invention includes providing piece of material and positioning it to form a sloped surface adjacent to the I-beam. The slope should be at a sufficient angle to prevent a person from standing on the lower flange of the I-beam, thereby making it much more difficult to vandalize the bridge.

BRIEF DESCRIPTION OF THE DRAWINGS

The above and other objects, features and advantages of the invention will become apparent from a consideration of the following detailed description presented in connection with the accompanying drawings, in which.

DETAILED DESCRIPTION

Figure 1:
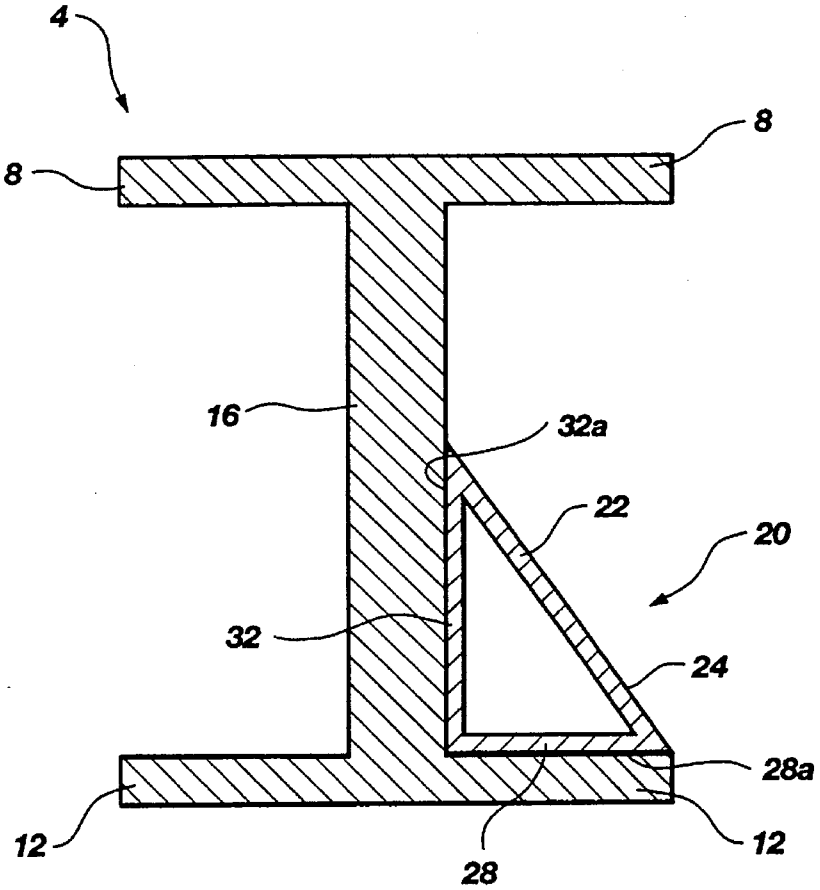
FIG. 1 shows a side cross-sectional view of an I-beam, such as that typically used to support highway bridges and other similar structures, with a slant plate device positioned adjacent the lower portions of the I-beam.

Reference will now be made to the drawings in which like structures will be given numeral designations, and in which each aspect of the invention will be explained in detail. Referring now to FIG. 1 there is shown a cross-sectional view of an I-beam, generally indicated at 4, such as those typically used for structural support of bridges and overpasses along highways. The I-beams 4 are usually positioned below the roadway and extend from one pillar to another, or from a pillar to the side of the bridge.

The I-beam 4 typically has an upper flange 8 and a lower flange 12, each of which extends generally horizontally. The flanges, 8 and 12 respectively, are separated by a web 16, or a generally vertical wall which joins the two flanges and provides structural support.

Also shown in FIG. 1 is a slant plate device, generally indicated at 20, which includes an elongate plate 22 positioned so as to provide a sloped surface 24 between the web 16 and the lower flange 12. The sloped surface 24 of the elongate plate 22 is designed so as to prevent a person from standing on the lower flange 12. As graffiti vandals often stand on the lower flange 12, the positioning of the slant plate device 20 prevents vandals from vandalizing the bridge.

The elongate plate 22 is supported by a horizontal wall 28 which runs generally parallel to the lower flange 12 and a generally vertical wall 32 which runs generally parallel to the web 16. The two walls, 28 and 32, provide support for the sloped surface 24 of the elongate plate 22, and an area for attaching the elongate plate to the I-beam 4. Adhesive can be placed along the outside edge 28*a* and 32*a*, respectively, of each wall so as to affix the walls, and thus the entire slant plate device 20 to the I-beam.

It is anticipated that the sloped surface 24 will have an angle of at least 45 degrees so as to prevent people from standing thereon. The slant plate device 20 should be made of a material, such as metal or rigid plastic which is durable enough to withstand the attempts of vandals to remove them from the I-beams 4. Additionally, the slant plate device 20 should be sufficiently visible that potential vandals will be able to see it, thereby preventing accidental injuries caused by someone falling from an I-beam due to a lack of footing. It is anticipated that the slant plate device 20 will be made of metal and painted so as to increase visibility and decrease corrosion due erosion by the weather.

Figure 2:
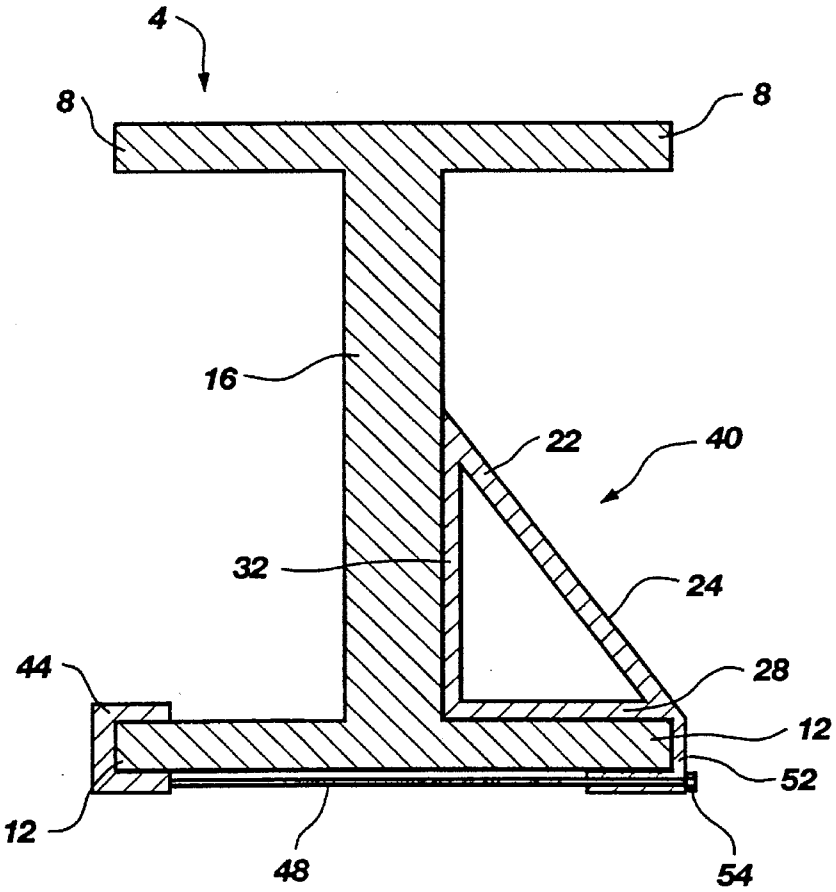
FIGS. 2–5 show alternate embodiments of slant plate devices made in accordance with the present invention, each device showing a different method of mounting the device upon I-beams.

Referring now to FIG. 2, there is shown an alternate embodiment of the present invention mounted to an I-beam 4. The slant plate device 40 is analogous to that shown in FIG. 1 in that is has an elongate plate 22, forming a sloped surface 24, and support walls 28 and 32. However, the slant plate device 24 is different from that shown in FIG. 1 in that the sloped surface 24 extends beyond the lateral limits of the lower flange 12 of the I-beam 4. As shown in FIG. 2, the slant plate device 40 forms a clamp for holding the device to the I-beam 4. The clamp involves a retainer section 44 which is held by a cord, cable or elastic device 48 to an extension 52 which projects down extension 52 which extends down from the slant plate device 40. When the cable or elastic device 48 is tightened so as to pull the extension and retainer together, the slant plate device 40 is held securely to the I-beam 4 so as to prevent vandals from standing on the lower flange 12. Those skilled in the art will recognize the numerous ways in which the cord, cable or elastic device 48 could be mounted between the retainer section 44 and the extension 52. As shown in FIG. 2, the cable is fixedly attached in the retainer section 44 and is adjustable relative to the extension 52 by rotating a nut 54.

An advantage of the clamp arrangement shown in FIG. 2 is that the slant plate device 40 can be attached or removed by adjusting the cable or elastic band 48. This is beneficial in that the slant plate device 40 can be removed if work was to be performed on the bridge. Additionally, if the particular I-beam 4 to which the slant plate device 40 is attached must be replaced, the slant plate device can simply be removed and reattached to the new I-beam.

Figure 3:
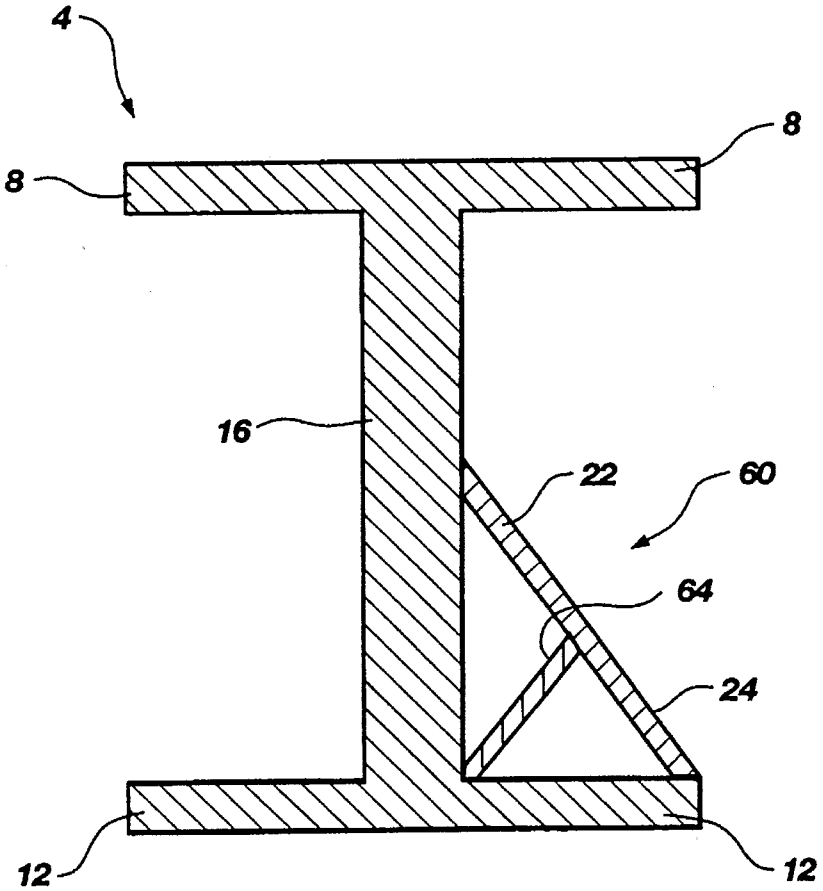

Referring now to FIG. 3, there is shown a side-cross sectional view of a slant plate device 60 positioned between the web 16 and the lower flange 12 of an I-beam 4. The slant plate device 60 has an elongate plate 22 which forms a sloped surface 24. The elongate plate 22 is supported by a single support wall 64 which extends perpendicular from the sloped surface 24. The single support wall 64 is beneficial in that it provides a lighter-weight slant plate device 60 in the event that weight is a concern. The support wall 64 can be adhesively affixed to the I-beam 4 or can be bolted or otherwise attached.

As was mentioned, with respect to the embodiment shown in FIG. 1, the angle of the sloped surface 24 should be great enough so that vandals may not stand on the lower flange 12. Thus, it may be beneficial to provide an adjustable attachment between the support wall 64 and the sloped surface 24 so as to achieve the proper slope with I-beams of different widths.

Figure 4:
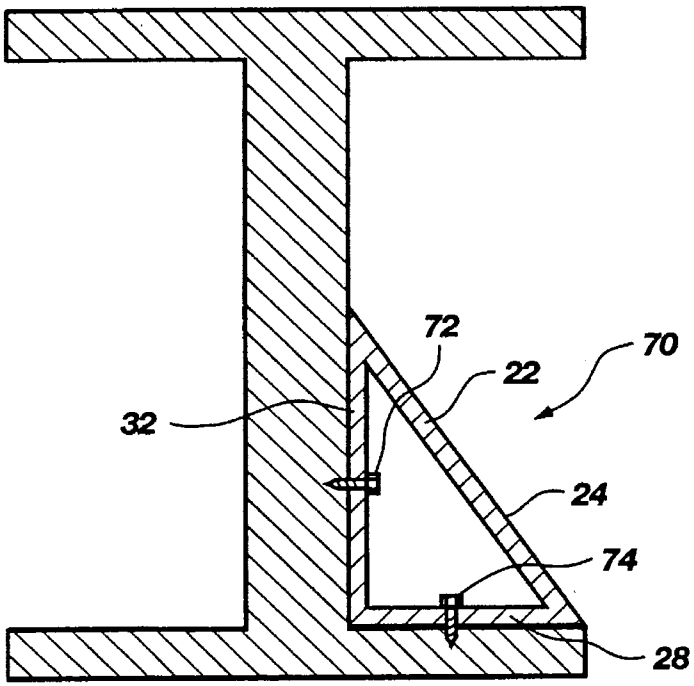

Referring now to FIG. 4, there is shown a slant plate device 70 similar to that shown in FIG. 1. Rather than being attached by adhesives, the slant plate device 70 is attached by a bolt 72 extending through the vertical side wall 32 and into the web 16. The slant plate device 70 is also affixed by a bolt 74 which extends through the horizontal support wall 28 and into the lower flange 12. While the use of two bolts is preferred for secure attachment, either of the bolts could be removed without rendering the device inoperable.

Figure 5:
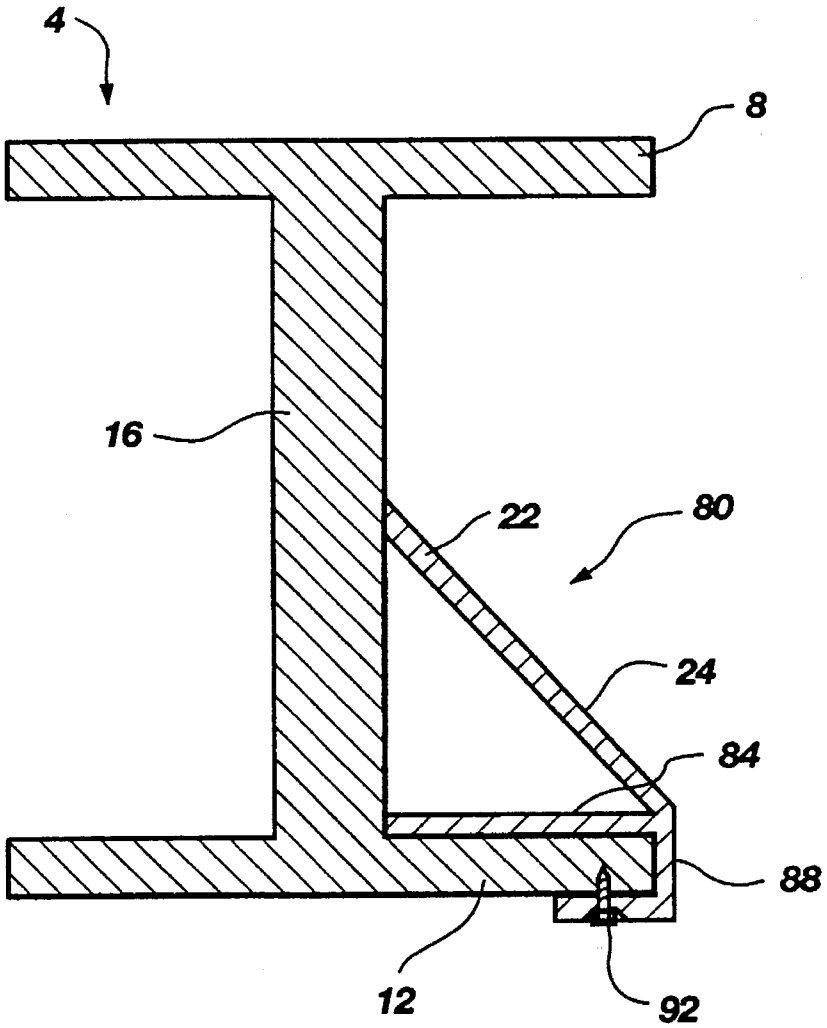

Referring now to FIG. 5, there is shown yet another embodiment of the present invention mounted to an I-beam 4. The slant plate device 80 has an elongate plate 22 forming a sloped surface 24 similar to that of the other embodiments. In contrast to the other embodiments, the slant plate device 80 has only a horizontal support wall 84 extending along the Lower flange 12. A projection 88 extends downwardly from the sloped surface 24 and wraps under the lower flange 12. The projection 88 is held in place by a set screw 92 which extends through the projection and into the lower flange 12.

The positioning of the set screw 92 allows for simple and efficient removal of the slant plate device 80 if such becomes necessary. Thus, the slant plate device 80 can be readily moved from one I-beam to another should the need arise.

Usually, a slant plate device such as those described above will be needed on the exposed side of the outermost I-beams. Thus, if a bridge has four I-beams supporting it, only the two outermost will need the slant plate device. This is due to the fact that graffiti between the I-beams will generally be less noticeable than that on the sides of the bridge. With the considerable resources which are being expended on graffiti removal, it would seem that such graffiti would be far lower in priority. However, if sufficient funds exist, a particular government agency may wish to prevent vandals from defacing any part of the bridge and may place a slant plate device on both sides of each I-beam.

In the manner described above, an apparatus and method is disclosed for preventing vandalism to bridges and the like. It will be understood that other variations and modifications of the apparatus and method will be apparent to those skilled in the art without departing from the scope of the invention. The describe method and apparatus are not meant to be a delineation of the scope of the invention, but merely an example of several embodiments thereof.

What is claimed is:

1. A method for inhibiting vandalism to bridges and the like which are supported by I-beams and similar structures, the method including:

(a) positioning an elongate plate adjacent to an I-beam so that the plate slopes downwardly and outwardly from a position adjacent a central, vertical wall of the I-beam to a position adjacent a lateral extreme of a flange comprising a lower portion of the I-beam at an angle sufficiently steep to inhibit a person from standing on the elongate plate;

(b) attaching the elongate plate to the I-beam so that the elongate plate is held in position adjacent the I-beam;

wherein step (b) comprises, more specifically, attaching the elongate plate to the I-beam; and further comprising providing a generally vertical support wall extending from an upper end of the elongate plate and extending generally parallel to the central, vertical wall of the I-beam.

2. The method of inhibiting vandalism to bridges and the like in claim 1, wherein step (a) comprises positioning the elongate plate such that the plate is at an angle of at least 45 degrees relative to the flange of the lower portion of the I-beam.

3. The method of inhibiting vandalism to bridges and the like in claim 1, further comprising adhesively attaching the vertical support wall to the central, vertical wall of the I-beam.

4. The method of inhibiting vandalism to bridges and the like in claim 1, further comprising attaching the vertical support wall to the central, vertical wall of the I-beam by passing a bolt through the vertical support wall and into the central, vertical wall of the I-beam.

5. The method of inhibiting vandalism to bridges and the like in claim 1, further comprising providing a generally horizontal support wall extending from a lower end of the elongate plate, generally parallel to the flange of the lower portion of the I-beam.

6. The method of inhibiting vandalism to bridges and the like in claim 5, further comprising adhesively attaching the horizontal support wall to the flange of the lower portion of the I-beam.

7. The method of inhibiting vandalism to bridges and the like in claim 5, further comprising attaching the horizontal support wall to the flange of the lower portion of the I-beam by passing a bolt through the horizontal support wall and into the flange of the lower portion of the I-beam.

8. The method of inhibiting vandalism to bridges and the like in claim 1, further comprising forming an extension extending downwardly from a lower end of the elongate plate such that the extension wraps underneath the flange of the Lower portion of the I-beam, thereby securing the elongate plate to the I-beam.

9. The method of inhibiting vandalism to bridges and the like of claim 8, wherein the method further includes passing a set screw through the extension so as to anchor the extension and the elongate plate to the I-beam.

10. The method of inhibiting vandalism to bridges and the like of claim 8, wherein the method further comprises positioning a retainer section on an opposing side of the flange of the lower portion of the I-beam and extending a retainer means between the retainer section and the extension so as to hold the extension adjacent the flange of the lower portion of the I-beam and to hold the elongate plate adjacent the I-beam.

11. An apparatus for inhibiting vandalism to bridges and the like, the apparatus comprising:

an elongate plate positioned at a slope and disposed such that the plate does not provide structural support to the I-beam and positioned adjacent to an I-beam so as to extend from a central position along a vertical wall of an I-beam downwardly and outwardly to a point adjacent a lateral edge of a flange forming a lower portion of the I-beam at an angle sufficient to inhibit a person from standing on the sloped plate;

support means for maintaining the position of the sloped plate and for attaching the sloped plate to the I-beam;

wherein the support means comprises an extension projecting generally downward and then wrapping underneath the flange and an anchor means attached to the extension for holding the extension adjacent to the flange, thereby maintaining the sloped plate at the desired angle; and wherein the anchor means comprises a retainer section disposed on a flange extending from an opposite side of the I-beam, and a retainer means attaching the retainer section to the extension, thereby holding the elongate plate adjacent to the I-beam.

12. The apparatus for inhibiting vandalism to bridges and the like of claim 11, wherein the support means comprises a generally horizontal wall extending from a lower end of the sloped plate inwardly toward the vertical wall of the I-beam, such that positioning the generally horizontal support wall on the flange maintains the sloped plate at a desired angle relative to the flange.

13. The apparatus for inhibiting vandalism to bridges and the like of claim 11, wherein the support means comprises a generally vertical well extending from an upper end of the sloped plate, parallel to the vertical wall of the I-beam, such that holding the generally vertical support wall to the vertical wall of the I-beam maintains the sloped plate at a desired angle relative to the vertical wall of the I-beam.

14. The apparatus for inhibiting vandalism to bridges and the like of claim 11, wherein the anchor means comprises a set screw for attaching the extension to the flange.

15. The apparatus for inhibiting vandalism to bridges and the like of claim 11, wherein the retainer means comprises a metallic cable.

16. The apparatus for inhibiting vandalism to bridges and the like of claim 11, wherein the retainer means comprises an elastic cable.

* * * * *